US005537796A

United States Patent [19]

Kliethermes, Jr.

[11] Patent Number: 5,537,796

[45] Date of Patent: Jul. 23, 1996

[54] RETAINING WALL BLOCK AND SYSTEM

[76] Inventor: John C. Kliethermes, Jr., 2212 Beam, Maplewood, Minn. 55019

[21] Appl. No.: 20,625

[22] Filed: Feb. 22, 1993

[51] Int. Cl.[6] ..... E04C 1/10

[52] U.S. Cl. ..... 52/592.6; 52/606

[58] Field of Search ..... 52/600, 603, 436, 52/437, 438, 605, 606, 593, 592.6, 604, 608; 446/125; 405/264

[56] References Cited

U.S. PATENT DOCUMENTS

| | | | |
|---|---|---|---|
| D. 336,686 | 6/1993 | Pederson | D25/118 |
| 429,061 | 5/1890 | Reynhold | 52/591 |
| 711,541 | 10/1902 | Standau | 52/591 |
| 1,689,107 | 10/1928 | Bradley | 52/591 |
| 1,886,404 | 11/1932 | Kipple | 52/606 |
| 1,971,545 | 8/1934 | Tompkins | 52/591 |
| 2,262,199 | 11/1941 | Paulson | 52/591 |
| 2,826,906 | 3/1958 | Rice | 52/606 |
| 3,005,282 | 10/1961 | Christiansen | 52/591 |
| 3,030,093 | 4/1962 | Reintjes | 52/605 X |
| 3,116,570 | 1/1964 | Torricelli | 52/284 X |
| 3,537,687 | 11/1970 | Adelman | 52/606 |
| 4,026,086 | 5/1977 | Langley | 446/125 X |
| 4,107,894 | 8/1978 | Mullins | 52/593 |
| 4,186,540 | 2/1980 | Mullins | 52/593 |
| 4,825,619 | 5/1989 | Forsberg | 52/562 |
| 4,928,469 | 5/1990 | Dorier | 52/604 X |
| 4,965,979 | 10/1990 | Larrivee et al. | 52/585 |
| 5,003,746 | 4/1991 | Wilston | 52/589 |
| 5,154,032 | 10/1992 | Ritter | 52/593 |
| 5,230,195 | 7/1993 | Sease | 52/593 |
| 5,421,135 | 6/1995 | Stevens | 52/604 |

*Primary Examiner*—Carl D. Friedman
*Assistant Examiner*—Beth A. Aubrey
*Attorney, Agent, or Firm*—Woodard, Emhardt, Naughton, Moriarty & McNett

[57] ABSTRACT

A construction block is disclosed having integral pins upstanding from its top surface and C-shaped slots adjacent to the pins extending through the block between its top and bottom surfaces. The block interlocks with other like blocks with the pins of the block being adjustably received in corresponding slots of the other like blocks. The slots are configured so that the blocks may be adjusted relative to each other to form both a straight wall and a set back wall.

13 Claims, 3 Drawing Sheets

RETAINING WALL BLOCK AND SYSTEM

BACKGROUND OF THE INVENTION

This invention relates generally to retaining wall systems and more particularly to a construction block for use interlocked with other like construction blocks in a retaining wall system.

Retaining walls have long been constructed from a variety of common building elements such as railroad ties, timber, bricks and stones. In recent years, construction blocks have been developed which are specifically adapted for and, therefore, dedicated to the construction of retaining walls. The design of these construction blocks is often intricate and far removed from the simple concrete rectangular shaped blocks long used in the construction of warehouses, basements and the like. For example, current retaining wall construction blocks do not require mortar between the blocks, instead employing various interlocking arrangements and oftentimes used in conjunction with the adjacent land to provide both a decorative, yet strong retaining wall.

The degree of skill required to build a retaining wall depends on the particular design of the block. For example, when building a retaining wall it is desirable for the stacked blocks to be set back from one another, thereby resulting in a canted, rather than vertical, wall which fully supports the adjacent earthen structure. The most simple of blocks require the skill of an artisan to provide the proper setback when building the retaining wall. Other blocks include frontal ridges or a tongue-in-groove construction for locating like blocks a fixed distance back from one another to provide a predetermined amount of setback. Still other blocks include holes extending through the block so that when stacked upon other like blocks, anchoring pins may be inserted through the aligned holes to result in a strengthened wall. See, for example, my prior U.S. Pat. No. 4,996,813.

Still, there is always a need for an improved retaining wall block design. For example, rather than using a separate anchoring pin for aligning concrete blocks atop one another, it would be desirable to have the pin incorporated with the concrete block. However, current concrete molding methods and masonry machinery limit the arrangement of the pins relative to the holes. With most concrete mold and masonry machinery used in this country, it is impossible to produce a concrete block having integral pins protruding from the top surface of the block and corresponding recesses in the bottom of the block directly underneath the pins. Therefore, it is also desirable for the concrete block to have integral pins and corresponding holes, while still being easily manufactured using present molding methods and masonry machinery.

Some retaining wall systems employ three or more different block designs in the construction of a retaining wall. In my prior U.S. Pat. No. 4,996,813, a common sound block was disclosed which could be used for both the straight sections and the corner sections of a retaining wall. Yet other common block designs are desirable as well. For example, it is desirable to have a common construction block which both interlocks with and adjusts relative to adjacent like blocks to form both straight and setback walls.

With these thoughts in mind, an improved retaining wall block is needed. The block should be of a common design and should interlock with other like construction blocks to form a retaining wall. Preferably, the block should be easily produced using standard concrete mold techniques and masonry machinery. Ideally, the block would be adjustable relative to adjacent like blocks to form both straight and setback walls.

SUMMARY OF THE INVENTION

A construction element for use with other like construction elements to build a retaining wall according to one embodiment of the present invention includes a block having parallel top and bottom surfaces. First and second pins extend upwardly from the top surface and define a longitudinal axis for the block. First and second slots are recessed in the bottom surface and are positioned adjacent to the first and second pins across the longitudinal axis. The block assembles with one or more other like blocks with the first and second pins being adjustably received in first or second slots of the one or more other like blocks. The block adjusts relative to the one or more other like blocks between a first position in which the longitudinal axis of the block is aligned with the longitudinal axis of the one or more other like blocks to form a straight wall and a second, set back position in which the longitudinal axis is set back from the longitudinal axis of the one or more other like blocks to form a set back wall.

One object of the present invention is to provide an improved retaining wall construction block.

Another object of the present invention is to provide a common retaining wall construction block which interlocks with other like construction blocks to form a retaining wall.

Still another object of the present invention is to provide a construction block which both interlocks with and adjusts relative to adjacent like blocks to form both straight and set back walls.

Yet another object of the present invention is to provide a construction block which is adjustable relative to adjacent like blocks between predetermined interlocked positions.

These and other related objects and advantages will become apparent from the following drawings and written description.

DESCRIPTION OF THE PREFERRED EMBODIMENT

Figure 1:
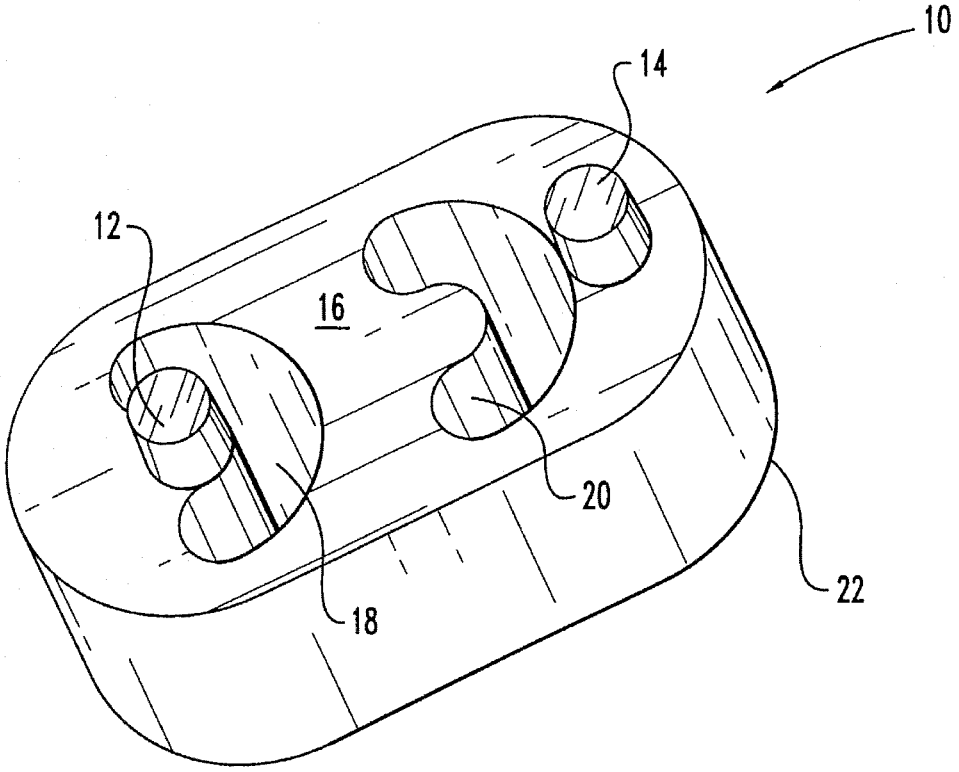
FIG. 1 is a perspective view of a retaining wall construction block according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, a construction block 10 is shown according to one embodiment of the present invention. Construction block 10 is a generally rectangular block having rounded ends and includes first and second pins 12 and 14 extending upwardly from top surface 16. Adjacent to pins 12 and 14 are slots 18 and 20. In the preferred embodiment, slots 18 and 20 extend through block 10 between top surface 16 and parallel bottom surface 22 to facilitate manufacture of the block.

Pins 12 and 14 are substantially cylindrical in shape and are sized to adjustably slide within slots 18 and 20 of another like block. In the preferred embodiment, block 10 is constructed from concrete and pins 12 and 14 are integrally molded with the remaining body of the block. However, pins 12 and 14 may also be fabricated separate from the block and then inserted within the body of the block prior to assembly of the block with other like blocks. Slots 18 and 20 are preferably disposed adjacent to pins 12 and 14. With most present mold and masonry machinery it is impossible to introduce a recess or void directly under each of pins 12 and 14. By disposing the slots adjacent to rather than directly underneath the pins, complex machinery is not required in the manufacture of the block. Additionally, by extending the slots through the block, rather than recessing the slots, the slots can be easily formed using cores when casting the block. Nevertheless, slots 18 and 20 are also contemplated as being merely recessed in the bottom surface 22 to a depth which will fully receive the corresponding pins therein. Because such a recessed configuration is difficult, if not impossible, to manufacture from blocks constructed of concrete, block 10 is contemplated as being constructed from other more easily molded materials. For example, in one embodiment block 10 may be molded from rubber or a synthetic thermoset plastic material having slots 18 and 20 recessed in the bottom surface 22, rather than extending therethrough.

Figure 2:
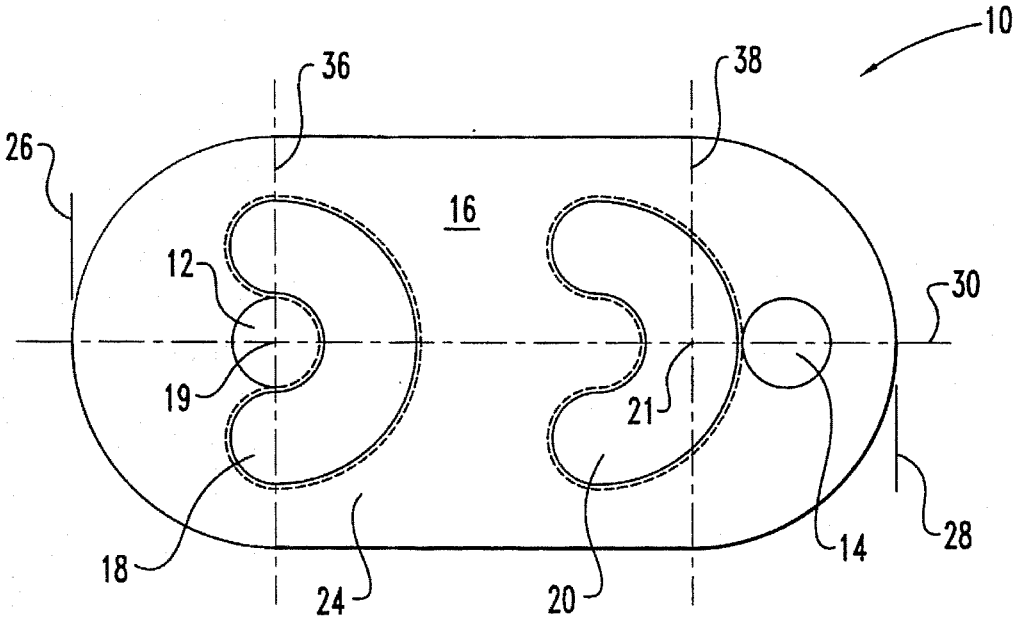
FIG. 2 is a top plan view of the construction block shown in FIG. 1.
Figure 3:
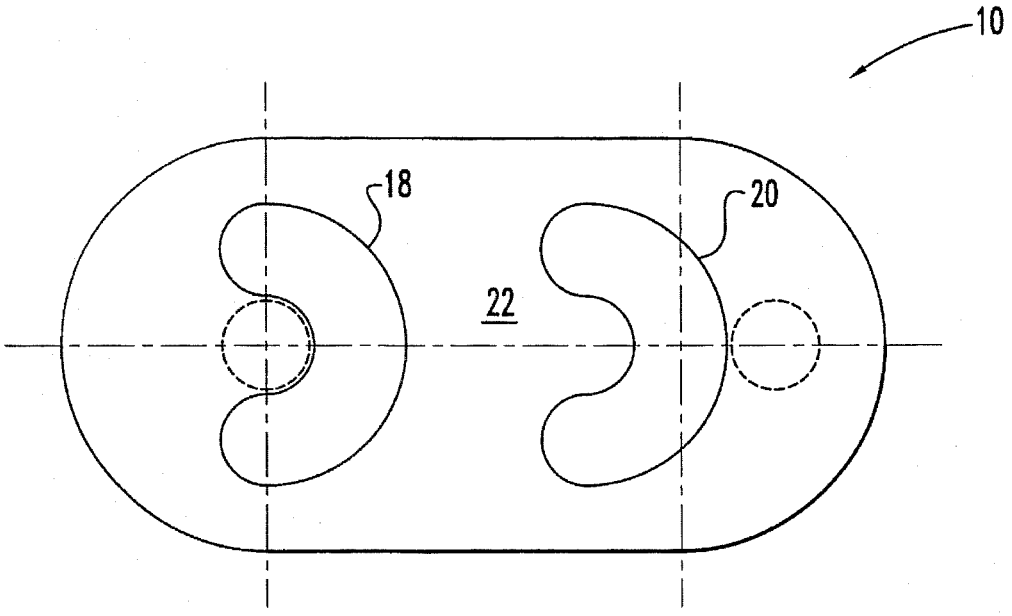
FIG. 3 is a bottom plan view of the construction block shown in FIG. 1.
Figure 4:
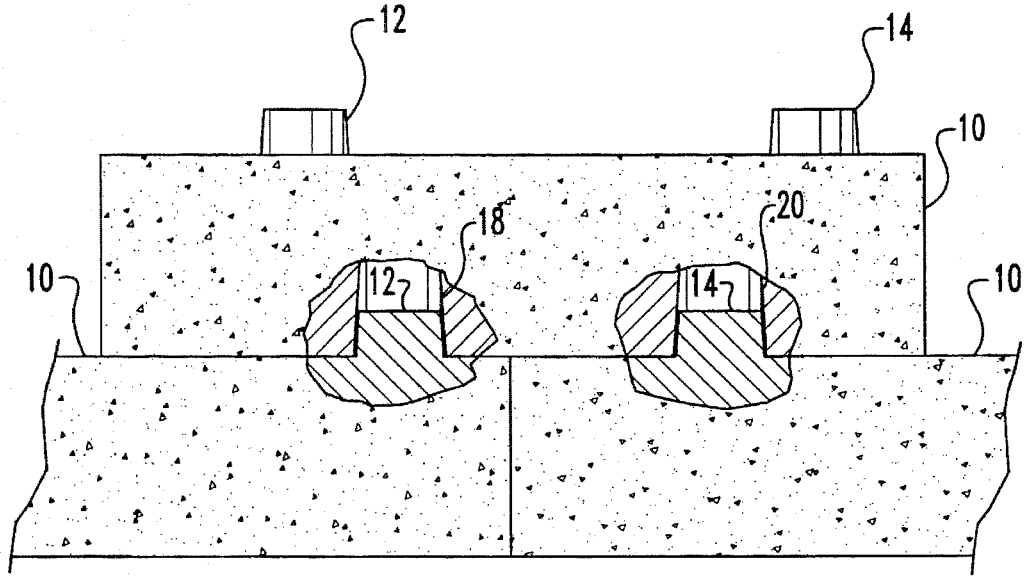
FIG. 4 is a side elevational, partial cutaway view of the construction block of FIG. 1 stacked upon other like construction blocks.

Referring now to FIGS. 2 and 3, construction block 10 is shown in greater detail. As shown by the shape of top surface 16, block 10 includes a rectangular shaped portion 24 and rounded end portions 26 and 28. In the preferred embodiment, end portions 26 and 28 are semi-circular in shape with like radii. Rectangular portion 24 preferably is square with both its length and width being twice the end portion radius. Slots 18 and 20 are preferably C-shaped with slot 18 a predetermined distance from and concentric about pin 12. Slot 20 is the same predetermined distance from pin 14, but is not concentric about pin 14. Instead, slot 20 is disposed on the other side of pin 14 so that both slots are situated between pins 12 and 14. As such, pins 12 and 14 are spaced further apart than are slots 18 and 20, and block 10 does not stack directly atop another like block with pin 12 received in slot 18 and pin 14 received in slot 20. Rather, block 10 is designed to stack upon opposite end portions of first and second like blocks as shown in FIG. 4, with pin 12 of the first like block received in slot 18 and pin 14 of the second like block received in slot 20. The slots and pins are positioned relative to each other and relative to the block so that laterally adjacent blocks are abutting. In particular, by pin 12 and slot 20 being aligned with the centers 19 and 21 of radiused end portions 26 and 28, respectively, and by slot 18 and pin 14 being positioned at like distances adjacent to pin 12 and slot 20, respectively, and by rectangular portion 24 being twice the length of radiused end portions 26 and 28, block 10 stacks with other like blocks to form a solid wall.

In addition to the wall shown in FIG. 4, block 10 can be positioned along the sides of adjacent like blocks so that the radiused end portions combine to present a decorative stone retaining wall. Further, other slots or openings can be incorporated transversely through the block between slots 18 and 20, for example, to provide both ventilation and/or drainage through the wall while still yielding an aesthetically pleasing pattern. Ideally, such through-slots would provide also handling means for the block to facilitate both manual and automatic handling of the block.

Figure 7:
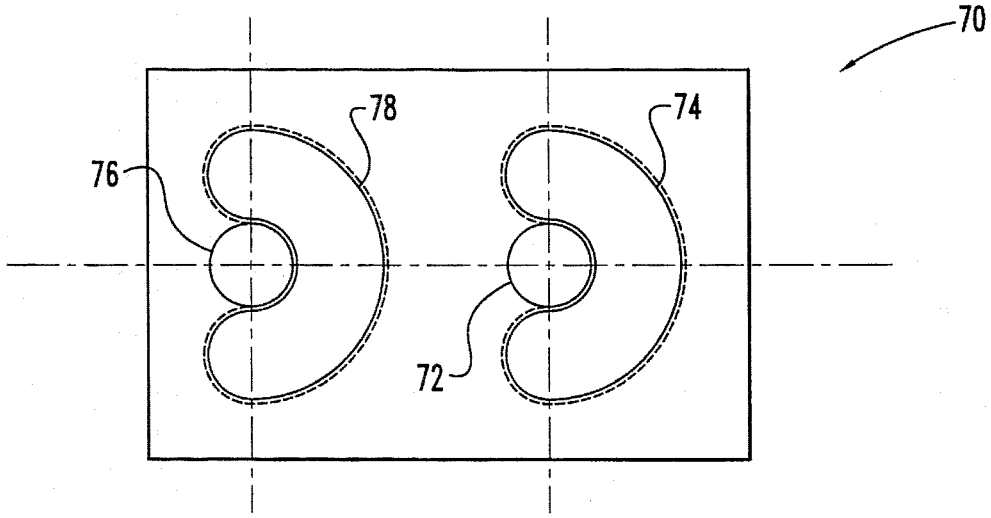
FIG. 7 is a top plan view of a retaining wall construction block according to a third embodiment of the present invention.

Yet a solid retaining wall is not always desirable. As described above, spacing between laterally adjacent blocks may be desired for drainage or to provide a decorative retaining wall which blends with the landscape. As such, block 10 may be constructed with rectangular portion 24 having a length greater than twice the length of radiused end portions 26 and 28 so that laterally adjacent blocks are not abutting. The resulting gaps between blocks may then be filled with natural foliage or the like to provide a retaining wall formed in conjunction with its natural surroundings. Further, block 10 may be configured rectangular as shown in FIG. 7. In FIG. 7, block 70 is shown having pin 72 and slot 74 positioned relative to each other identical to the positioning of pin 76 and slot 78, wherein both slots 74 and 78 are adjacent to and concentric about pins 72 and 76, respectively. Unlike block 10, the pins and slots of block 70 are spaced equally so that block 70 can also stack directly upon another like block.

Referring back to block 10 of FIGS. 1 through 4, when stacked upon other like blocks, pins 12 and 14 are adjustable within C-shaped slots 18 and 20. Because slots 18 and 20 extend at least 90 degrees between horizontal and transverse axes (axis 30 and axes 36 and 38, respectively), blocks 10 form both a substantially flat straight wall with longitudinal axes 30 aligned and a set back wall with transverse axes 36 and 38 aligned. Preferably, slots 18 and 20 extend 180 degrees as shown in FIG. 2 so that setback is provided in either direction along axes 36 and 38, wherein pins 12 and 14 are adjustable within the slots 18 and 20 between a position centrally located within the slot (aligned with axis 30) and a position at either end of the slot (aligned with axis 36 and parallel with axis 38). Additionally, by positioning blocks 10 perpendicular with each other, the blocks provide corners as well for a retaining wall. Previous retaining wall systems have required a special block specifically tailored and dedicated as a corner block to provide a corner for a retaining wall. In the preferred embodiment, U-shaped slots similar to the C-shaped slots 18 and 20 previously discussed are provided so as to present a flush retaining wall corner when aligned with other like blocks. By providing a retaining wall block that is adjustable relative to other like blocks to provide flush or set back retaining walls, or to provide a corner for a retaining wall, the present invention provides a novel common retaining wall block that is usable in the construction of a retaining wall system without requiring specially tailored or otherwise dedicated retaining wall blocks.

Figure 5:
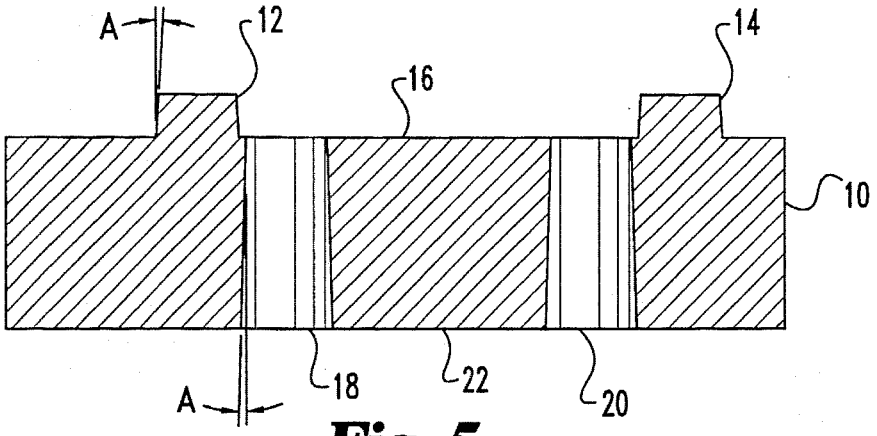
FIG. 5 is a side, cross-sectional view of the construction block of FIG. 1.

As shown in FIG. 5, pins 12 and 14 are slightly tapered inward as they extend upward from top surface 16. Similarly, slots 18 and 20 are slightly tapered inward as they extend upward from bottom surface 22. As such, lateral play is provided between the blocks when the pins are initially introduced into the slots. When the adjacent blocks are fully seated, the lateral play is eliminated as the tapered pins conform with the tapered slots so that block 10 only adjusts relative to another like block along the arcuate path defined by C-shaped slots 18 and 20.

Figure 6:
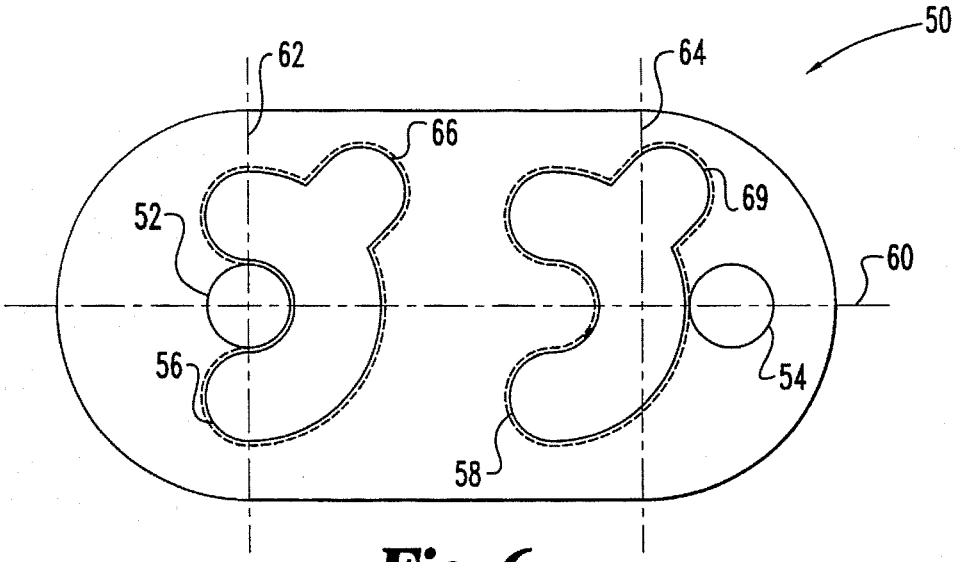
FIG. 6 is a top plan view of a retaining wall construction block according to a second embodiment of the present invention.

Slots 18 and 20 may incorporate other shapes as well. For example, referring now to FIG. 6, a construction block 50 is shown having pins 52 and 54 and corresponding slots 58 and 56. Similar to block 10, pins 52 and 54 are adjustable within slots 58 and 56 so that block 50 may be aligned with other like blocks along longitudinal axis 60 or along transverse axes 62 and 64. However, construction block 50 further includes locating or indexing slots 66 and 68. As such, pins 52 and 54, while still being adjustable within slots 58 and 56, can be partially locked into position within locating slots 68 and 66, respectively. The locating or indexing slots shown in FIG. 6 may also be configured to provide partially locked positions elsewhere along C-shaped slots 56 and 58, including along axis 60 and/or axes 62 and 64.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A construction element for use with other like construction elements to build a retaining wall, comprising:

a block having parallel top and bottom surfaces;

a first pin extending upwardly from said top surface;

a second pin extending upwardly from said top surface;

said first and second pins defining a longitudinal axis for the construction element;

a first slot recessed in said bottom surface and positioned adjacent and offset to said first pin, said first slot extending across said longitudinal axis; and a second slot recessed in said bottom surface and positioned adjacent and offset to said second pin, said second slot extending across said longitudinal axis;

wherein said pins of the construction element are receivable within like slots of other like construction elements, said pins of the construction element being continuously adjustable within the like slots of other like construction elements for positioning the construction element in a first position relative to other like construction elements to form a flush wall and a second position relative to other like construction elements to form a set back wall.

2. The construction element of claim 1, wherein:

said block includes a rectangular shaped central portion having sides parallel with said longitudinal axis and semi-circular shaped ends having like radii and disposed between said sides.

3. The construction element of claim 2, wherein:

said first and second slots which extend through said block between said top and bottom surfaces;

said first slot extending from said longitudinal axis 90 degrees to a first transverse axes, said first transverse axis perpendicular to said longitudinal axis and parallel with said top surface of said block;

said second slot extending from said longitudinal axis 90 degrees to a second transverse axis, said second transverse axis perpendicular to said longitudinal axis and parallel with said top surface of said block; and said block adjusts relative to the one or more other like blocks between a first position in which said sides of said rectangular shaped central portion are aligned with the sides of the one or more other like blocks and a second, set back position in which said semi-circular shaped ends are aligned with the ends of the one or more other like blocks.

4. The construction element of claim 3, wherein:

said first and second slots are C-shaped slots; and said first slot is concentric about said first pin.

5. The construction element of claim 4, wherein:

said first and second C-shaped slots are aligned symmetrically on said longitudinal axis between said first and second pins; and said block assembles with at least two other like blocks with said first pin adjustably received in the second slot of one of the at least two other like blocks and the second pin adjustably received in the first slot of the other of the at least two other like blocks.

6. The construction element of claim 5, wherein:

said rectangular shaped central portion is square; and said sides have a length which is twice the radius of one of said semi-circular shaped ends.

7. The construction element of claim 6, wherein:

said first and second C-shaped slots include first and second locating slots, respectively; and said first and second pins are adjustable in the second and first C-shaped slots, respectively, of the at least two other like blocks and are partially lockable in said second and first locating slots, respectively, of the at least two other like blocks.

8. A retaining wall system, comprising:

a plurality of blocks, each block including:

(a) parallel top and bottom surfaces;

(b) a first pin extending upwardly from said top surface;

(c) a second pin extending upwardly from said top surface, said first and second pins defining a longitudinal axis for said block;

(d) a first slot extending between said top and bottom surfaces and positioned adjacent and offset to said first pin, said first slot extending across said longitudinal axis; and (e) a second slot extending between said top and bottom surfaces and positioned adjacent and offset to said second pin and extending across said longitudinal axis, said first and second slots being aligned on said longitudinal axis between said first and second pins;

wherein one of said plurality of blocks assembles with at least two other of said plurality of blocks with said first pin of said one block received in said second slot of one of said at least two other blocks and said second pin of said one block received in said first slot of another of said at least two other blocks, said pins of said one block continuously adjustable within said slots of said at least two other blocks for positioning said one block flush or set back relative to said two other blocks.

9. The retaining wall system of claim 8, wherein:

each of said plurality of blocks includes a rectangular shaped central portion having sides parallel with said longitudinal axis and semi-circular shaped ends having like radii and disposed between said sides.

10. The retaining wall system of claim 9, wherein:

said first and second are arcuate slots extending 90 degrees from said longitudinal axis, said first and second slots extend to a first and second transverse axis that are perpendicular to said longitudinal axis and parallel with said top surface;

said one block adjusts relative to said at least two other blocks between a first position in which said sides of said one block and said at least two other blocks are aligned and a second, set back position in which said semi-circular shaped ends of said one block and said at least two other blocks area aligned.

11. The retaining wall system of claim 10, wherein:

said first and second slots are C-shaped slots; and said first slot is concentric about said first pin.

12. The retaining wall system of claim 11, wherein:

said rectangular shaped central portion is square; and said sides have a length which is twice the radius of one of said semi-circular shaped ends.

13. The retaining wall system of claim 12, wherein:

said first and second C-shaped slots include first and second locating slots, respectively; and said first and second pins of said one block are adjustable in the second and first C-shaped slots, respectively, of said at least two other blocks and are partially lockable in said second and first locating slots, respectively, of said at least two other blocks.

* * * * *

UNITED STATES PATENT AND TRADEMARK OFFICE
CERTIFICATE OF CORRECTION

PATENT NO. : 5,537,796

DATED : July 23, 1996

INVENTOR(S) : John C. Kliethermes, Jr.

It is certified that error appears in the above-identified patent and that said Letters Patent is hereby corrected as shown below:

In claim 3, line 55, please insert --are arcuate slots" after, "said first and second slots".

In claim 10, line 63, after said first and second, please insert "slots" and in col. 7, line 6 of claim 10, please replace "area" with --are--.

Signed and Sealed this

Seventeenth Day of June, 1997

*Attest:*

*Attesting Officer*

BRUCE LEHMAN

*Commissioner of Patents and Trademarks*